United States Patent [19]

Umstead

[11] 3,940,023

[45] Feb. 24, 1976

[54] CHILD-PROOF SAFETY LOCKING DEVICE

[75] Inventor: Herbert R. Umstead, Warwick, N.Y.

[73] Assignee: Avon Products, Inc., Suffern, N.Y.

[22] Filed: Nov. 27, 1974

[21] Appl. No.: 527,804

[52] U.S. Cl. ..... 222/153; 222/402.11

[51] Int. Cl.[2] ..... B65D 83/14

[58] Field of Search ..... 215/9; 222/402.11, 153; 251/90, 92, 93

[56] References Cited

UNITED STATES PATENTS

| | | | |
|---|---|---|---|
| 3,828,982 | 8/1974 | Steigerwald | 222/402.11 X |
| 3,837,537 | 9/1974 | Baldwin | 222/402.11 |

FOREIGN PATENTS OR APPLICATIONS

| | | | |
|---|---|---|---|
| 967,950 | 8/1964 | United Kingdom | 222/402.11 |

*Primary Examiner*—Allen N. Knowles
*Assistant Examiner*—Norman L. Stack, Jr.
*Attorney, Agent, or Firm*—Pennie & Edmonds

[57] ABSTRACT

A safety locking device particularly adapted for use in selectively inhibiting actuation of an aerosol valve assembly for an aerosol container having a movable valve stem connected to a push-button actuator head which stem is slidable within a valve pedestal formed on the valve assembly. The safety locking device embodies, in integral combination, at least a pair of first and second locking means formed adjacent opposite ends thereof and a biased hinge means. Interconnecting the first and second locking means is the biased hinge means which biases the second locking means relative to the first locking means such that whenever the first locking means is secured to the valve pedestal, the second locking means is biased to the locking position where it is interposed between the actuator head and pedestal. In addition, the hinge means automatically returns the second locking means from the unlocked position to the locked position whenever application of forces sufficient to overcome the bias of the biased hinge means for urging the second locking means towards the unlocked position is released.

14 Claims, 9 Drawing Figures

CHILD-PROOF SAFETY LOCKING DEVICE

BACKGROUND OF THE INVENTION

1. Field of the Invention

The instant invention generally pertains to safety locking devices and, more particularly, to child-proof safety devices particularly useful on aerosol containers or the like.

2. Description of the Prior Art

Conventional aerosol type containers find wide commercial use and, in fact, are common household items. Typically, such aerosol containers serve to contain and selectively dispense numerous types of pressurized fluids for personal and household uses. Such conventional aerosol containers are normally comprised of a generally cylindrical canister member, a top section which is approximately crimped or rolled on the canister, and a conventional aerosol type valve assemble centrally disposed and retained by the top section. Suitably and slidably mounted within the valve assembly is a valve stem which has secured thereto a push-button actuator head. The actuator head normally has a nozzle for purposes of emitting a stream of pressurized fluid. Ordinarily, a user of such valve, in order to dispense the pressurized contents thereof, merely depresses the push-button actuator head downwardly towards the canister member to thereby permit the stream of pressurized fluid to emanate through the nozzle. Such aerosol type valves are typically constructed so as to be easily depressed by a user thereof.

Since, as aforementioned, the aerosol containers are widely used for varying purposes there exists a somewhat high probability that young children will come into contact with and perhaps use such containers in a manner not intended. Considering that in certain circumstances the pressurized fluid may be of a generally toxic or otherwise harmful nature, a child may by merely depressing the aerosol push-button actuator head inadvertently dispense a pressurized spray of the toxic or otherwise harmful substance on himself or surrounding persons and/or property to the detriment of such persons or property. As, therefore, can be readily appreciated by virtue of the commonality of such aerosol spray containers, the rather high likelihood of their being accessible to children and the relative ease with which they might be depressed, combine to present a somewhat dangerous situation.

Early attempts to provide tamperproof and child-proof dispensers employed detachable overcaps designed to cover the button actuators. Such approaches were generally simple and children with little effort were able to operate the dispensers. Moreover, these types of overcaps suffered another disadvantage in that they might have inadvertently been left off.

Other approaches, such as described generally in the U.S. Pat. Nos. 2,686,652 and 3,158,292 suffer from shortcomings, among which are that they do not provide safety devices which automatically relock and, in addition, such devices are in certain circumstances, able to be completely removed from the aerosol container with the consequent result that they may become lost.

More recent prior art approaches for providing safety devices which serve to prevent a young child from inadvertently dispensing the pressurized substance from the aerosol containers utilize mechanisms which require a sequence of operations to be performed before the contents can be dispensed. Normally, these sequences are beyond the capability of young children, However, such mechanisms usually must be independently relocked by repositioning the locking mechanism. Thus, the locking feature might be thwarted by failing to relock the safety mechanism. It is obvious, therefore, that such locking mechanisms under such circumstances would fail to perform its intended function. Consequently, such approaches have not proved entirely satisfactory. Another known approach is generally described in U.S. Pat. No. 3,786,968. The device disclosed therein, however, is a safety device for an aerosol dispenser which is rather complicated in structure, expensive in production, and not very versatile or adaptable for use in conjunction with the wide variety of aerosol containers and valves presently available on the market. In addition, such known approach is not easily encompassed by the normal aerosol protective caps ordinarily associated with conventional aerosol spray containers, and are not as reliable as would be desired.

SUMMARY OF THE INVENTION

Accordingly, therefore, it becomes an object of the present invention to overcome the aforementioned difficulties prevalent with the use of conventional child-proof safety locking devices presently used in conjunction with aerosol spray containers and the like. The present invention contemplates a novel and improved safety locking device which is particularly adaptable for use on a wide variety of conventional aerosol valves associated with the aerosol spray cans. Such safety device owing to its unique, simple unitary construction, and inherent resiliency is basically effective, in a reliable manner, to inhibit young children from inadvertently depressing the push-button actuator head of the aerosol valve. In addition, such safety device not only facilitates the easy actuation of such aerosol valves by an older user thereof but also insures automatic relocking of the valve.

Briefly, as hereinafter set forth, the safety locking device of the present invention is particularly adapted for use in inhibiting a child from dispensing pressurized contents of an aerosol spray container by selectively locking an aerosol dispensing valve, such that some skill or competency is required to unlock the dispensing valve. Typically, the dispensing valve includes a movable valve stem which has connected thereto a manually depressible push-button actuator head which is slidable within a valve pedestal formed on an aerosol container for appropriately dispensing the pressurized contents of such container in response to depression of the push-button head.

Essentially, the child-proof safety locking device comprises, in integral combination, at least a pair of first and second locking means formed adjacent opposite ends of the locking device and a biased hinge means. The first locking means includes a first locking ring-like member and a first connecting portion which serves to interconnect the first locking ring-like member to the biased joint means. Such first locking ring is adapted to be secured to the valve pedestal and functions to permit slidable travel of the valve stem therethrough. Also in a preferred embodiment, the second locking means includes a second locking member having a generally elliptical-shaped opening formed therethrough with an obstruction portion and connected thereto a second connecting arm portion which connects the second locking member to the biased joint means. The elliptical opening is movable between a locked and unlocked position wherein, whenever in the locked position, the obstruction portion is interposed between the actuator head and the valve pedestal so as to prevent depression of the actuator head toward the valve pedestal, and whenever in the unlocked position, the obstruction portion no longer obstructs movement of the valve stem towards the valve pedestal and the remainder of the elliptical opening is aligned with the head so as to thereby permit depression of the actuator head toward the valve pedestal. The biased hinge means serves to bias the second locking means with respect to the first locking means such that whenever the first locking ring is secured to the valve pedestal, the obstruction portion of the second locking member is moved to the locking position. In addition, the biased hinge means permits the second locking member to be moved to the unlocked position upon application of forces sufficient to overcome the bias of the biased hinge means while automatically allowing the second locking member to return to the locked position upon release of such forces.

As can, therefore, be appreciated, for a chile to successfully operate the dispensing valve, the locking device must be manipulated such that the aforenoted alignment between actuator head and second locking member is attained and the simultaneous retention of such alignment and depression of the actuator head must be performed for a dispensing of the contents. While such action can be easily performed by adults it is believed that such is beyond the competency of young children.

BRIEF DESCRIPTION OF THE DRAWINGS

The above, as well as other objects, features, and advantages of the present invention will become readily apparent upon a detailed description of a preferred embodiment thereof when viewed in conjunction with the accompanying drawings wherein like reference numerals indicate like structure throughout the several views.

DETAILED DESCRIPTION

Figure 1:
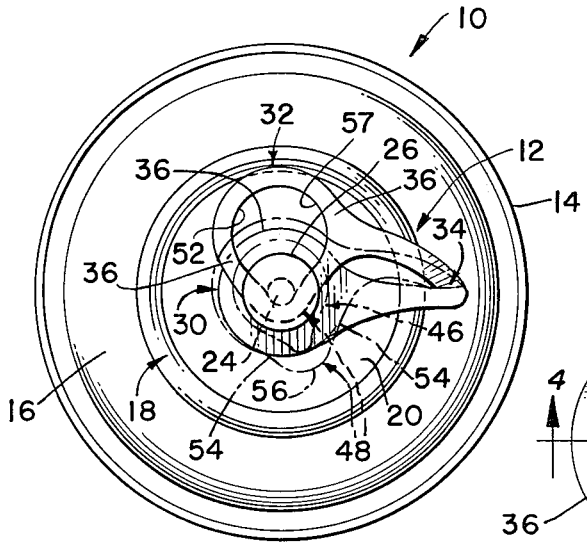
FIG. 1 is a plan view of a conventional aerosol spray container having attached thereto a preferred embodiment of a child-proof safety locking device embodying the principles of the present invention.

Referring now to the drawings there is disclosed a portion of a conventional aerosol spray container 10 having removably secured thereto in a manner to be afterwards more fully described, a preferred embodiment of a child-proof locking device made in accordance with the principles of the present invention and generally designated by reference numeral 12.

Figure 5:
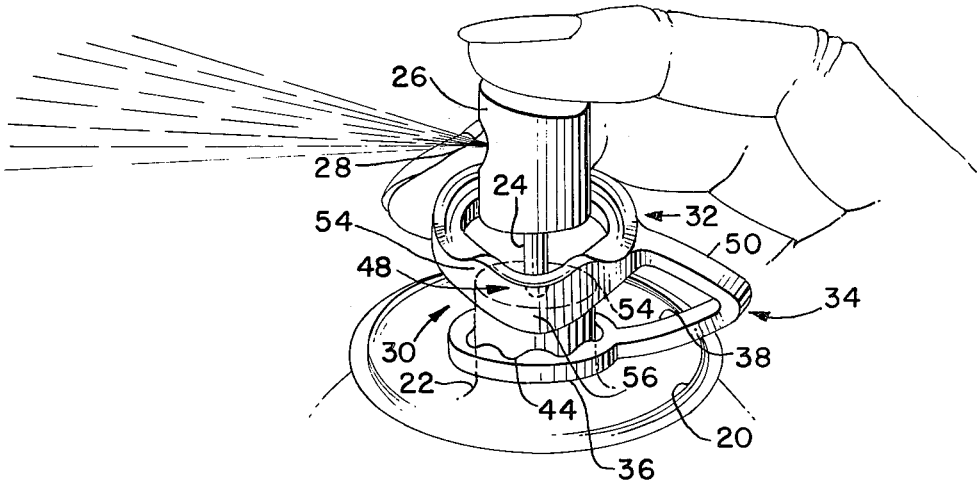
FIG. 5 is a perspective view showing a user thereof moving the child-proof safety locking device to the unlocked position.

Particularly referring to FIG. 1 taken in concurrence with FIG. 5, the aerosol spray can container 10 adapted for use in connection with the safety locking device 12 of the present invention may be any conventional type which is constructed the operated in a known manner. Accordingly, a detailed description thereof has been omitted since such is considered to be well-known in the art. To better understand the operation of the child-proof safety locking device 12, however, only those features of the aerosol spray container 10 necessary for a complete and adequate disclosure of the present invention will be subsequently discussed.

Such aerosol spray container 10 is generally comprised of a hollow, usually metallic, cylindrical container generally referred to by reference numeral 14, and having suitably crimped or rolled thereto a generally dome-shaped top section or cup member 16. Centrally disposed and suitably mounted on the dome-shaped top section 16 is a conventional aerosol type dispensing valve assembly means 18 having a well-known type construction and operation. Ordinarily, such dispensing valve assembly means 18 typically comprises a generally cup-shaped retaining member 20 having formed thereon a centrally protruding valve pedestal or turret 22, a valve stem 24, and a manually depressible push-button actuator head 26. The centally arranged cup-shaped retaining member 20 is appropriately crimped or otherwise suitably fastened to the dome-shaped cup member 20. The valve stem 24 is slidably mounted in well-known fashion for generally vertical reciprocal movement within the valve pedestal 22 and has detachably connected at the upper end thereof the manually depressible push-button actuator head 26. Normally, both the valve stem 24 and actuator head 26 are biased in an upward position and are operated such that whenever the actuator head is manually depressed so as to move toward the valve pedestal 22 the pressurized fluid contents of the container is enabled to be appropriately discharged in the form of a spray through the discharge orifice or nozzle 28 formed in the actuator head 26.

Figure 2:
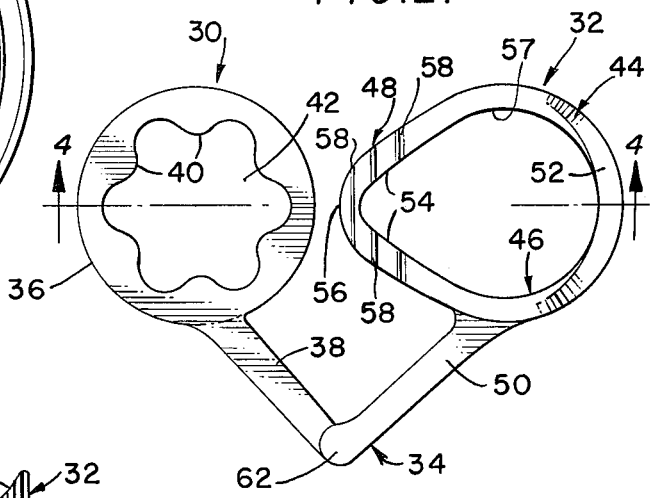
FIG. 2 is an enlarged view of one preferred embodiment of the child-proof safety locking device as illustrated in FIG. 1.
Figure 3:
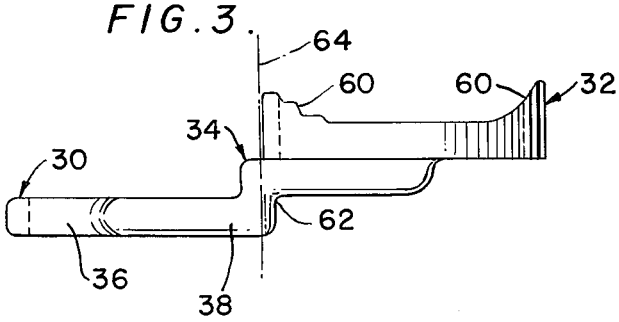
FIG. 3 is a side elevational view of the child-proof safety locking device as generally depicted in FIG. 2.
Figure 4:
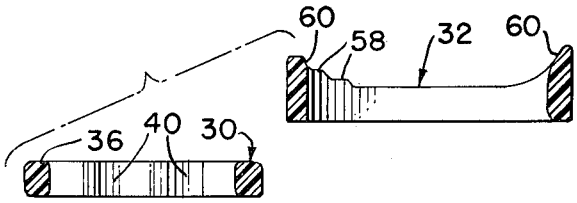
FIG. 4 is a sectional side elevational view taken substantially along section line 4—4 in FIG. 2 illustrating the safety locking device of the present invention.

With reference to FIGS. 2, 3 and 4, there is perhaps more precisely depicted the novel and improved child-proof locking device 12 of the preferred embodiment. The safety lock device 12 is contemplated as being fabricated in a unique, unitary construction and made from suitable resilient material for purposes afterwards made apparent. Such child-proof safety locking device 12 comprises, in integral combination, a pair of first and second locking means 30 and 32, respectively, which are formed adjacent opposite ends of the safety locking device, and a biased joint or hinge means 34 which serves to interconnect the first and second locking means 30 and 32, as well as to bias and orient the second locking means 30 with respect to the first locking means 30 for the purposes to be presently hereinafter set forth.

As shown in FIG. 2, the first locking means 30 is generally comprised of a first locking ring-shaped member 36 which has connected thereto a first locking connecting arm portion 38. Formed on the internal periphery of the first locking ring member 36 is a plurality of resilient serrated edges 40 which are appropriately dimensioned snugly fit around the wide range of valve pedestal diameters commonly found on contemporary aerosol spray containers. Thusly, the locking device is very versatile. Although the first locking means 30 has been defined by a generally annular or ring-shaped locking member 36, it is to be understood, of course, that other configurations for such locking member 36 may be utilized so long as the opening 42 extending therethrough is appropriately dimensioned to be snugly fitted over a valve pedestal. The manner by which the resilient serrated edges 40 are attached to and secure the safety locking device 12 to the valve pedestal 22 is clearly depicted in FIG. 5.

With continued reference to FIG. 2 taken in conjunction with FIGS. 3 and 4, one preferred embodiment of the second locking means 32 of the present invention is more clearly depicted. As therein shown, such second locking means 32 basically comprises a second locking member 44 which defines therethrough a generally elliptically-shaped opening 46, and an obstruction portion 48 formed at one end thereof. The second locking means 32 further includes a second connecting arm portion 50 which also, as shown in FIG. 2, serves to connect the second locking member 44 to the biased joint means 34. The second locking means 32 is normally urged to a locking position such as shown by the solid lines in FIG. 1. In this position, it will be noticed that the obstruction portion 48 is situated generally beneath the actuator head 26. Whenever so situated, the obstruction portion 48, in a manner to be presently described, serves to obstruct the downward movement of the actuator head 26 upon manual depression of the latter. Of course, for such obstruction to work effectively, the thickness of the obstruction portion 48 should be such that the valve stem 24 cannot complete its normal downward stroke necessary to dispense the fluid. The obstruction portion 48 is basically defined by a generally V-shaped segment formed on the second locking member 44 and extends generally laterally from an otherwise generally annular ring portion 52 which forms the remainder of the second locking member 44. Such obstruction portion 48 is formed by a pair of obstruction arm members 54 joined together at an apex 56. Whenever the second locking member 44 is biased to the locked position, the apex 56 of the obstruction portion 48 will contact the valve stem 24 and the obstruction arm members 54 will be appropriately situated beneath the push-button actuator head 26. Accordingly, by virtue of the apex 56 and obstruction arm members 54 being positioned as above indicated, upon manual depression of the actuator head 26, the dispensing valve assembly 18 will be unable to dispense the pressurized contents, since the dispensing valve stem 24 does not complete its normal downward stroke. Consequently, the pressurized fluid of the aerosol spray container 10 is not discharged in the form of a spray through the discharge nozzle 28.

The remaining opening portion 57 of the generally elliptical opening 40, defined by the annular ring portion 52, has a generally circular configuration and is appropriately dimensioned so that whenever the second locking means 32 is situated in the unlocked position, as indicated by the phantom lines in FIG. 1 the push-button actuator head 26 is aligned and may pass therethrough so as to appropriately actuate the valve dispensing means 18. In this manner, as can be appreciated, the pressurized contents of the aerosol container 10 is dispensed in the manner intended. It should be emphasized, however, that although the preferred embodiment has disclosed the second locking member 44 as defining a generally elliptical opening 46, it is well within the spirit and scope of the present invention that other shaped openings are envisioned for use, so long as they obstruct movement of the push-button actuator head 26 in one position and when moved to a second position enable the push-button actuator head to be sufficiently depressed so as to enable actuation of the dispensing valve assembly means 18.

The obstruction portion 48 may be additionally formed with a plurality of generally elongated and parallel spaced apart grooves 58. Such grooves 58, as contemplated by the present invention, are designed to prevent side slippage of the second locking member 44 with respect to the actuator head 26 upon downward movement of the actuator head. Accordingly, it will be readily appreciated, that the pressurized contents of the aerosol container 10 will not be inadvertently dispensed or discharged whenever the actuator head 26 is downwardly depressed while the second locking member 44 is in the locked position. Moreover, in this preferred embodiment of the instant invention, the second locking member 44 is provided with tapered opposite end sections 60, such as more clearly viewed in FIGS. 3 and 4. These tapered end sections 60 are contemplated for accommodating the wide range of heights, the valve stem 24 and actuator head 26 may be located above the second locking member 44. By this particular arrangement, it is intended that should the valve stem 24 and actuator head 26, for a particular aerosol spray container be depressed by a smaller distance than required in other aerosol containers in order to actuate the dispensing valve, the generally tapered end sections 60 prevent any such smaller downward movement from actuating the container. This additional feature, of course, adds to the versatility of the safety device 12 of the instant invention.

As mentioned previously, the first and second connecting arm portions 38 and 50 serve to respectively interconnect the first locking member 36 and the second locking member 44 to the biased hinge means 34. Such biased hinge means 34 is effective, by reason of its inherent resiliency, to yieldingly urge the second locking member 44 in one particular direction with respect to the first locking member 36 for purposes to be subsequently set forth. Moreover the hinge means 34 serves to elevate the second locking member 44 with respect to the first locking member 36. In this particular fashion, whenever the first locking member 36 is secured to the valve pedestal 22 the second locking member 44 will normally be interposed between the actuator head 26 and pedestal 22.

Specifically referring to FIG. 3 the biased hinge means 34 is basically defined by a generally cylindrical portion or knee member 62 which biases the second locking means 32 generally about a pivotal axis 64 extending through the longitudinal extent of the knee member 62. Since the safety locking device 12, as aforementioned, is fabricated from a resilient material, applicant's aforenoted construction results in a safety locking device being inherently biased. Such biasing serves to normally force or yieldingly drive the second locking member 44 away from the first locking member 36. In this manner, whenever the first locking member is appropriately secured to a valve pedestal 22, the hinge means 34 will, by virtue of its inherent resiliency, force second locking member 44 to the locking position, as indicated in FIG. 1. Towards the end of providing the safety locking device 12 with sufficient resiliency to perform the type of biasing as above indicated, the safety locking device 12 may be manufactured from any suitable elastomeric or resilient material. One such type of material which has been found to be adequate in performing the intended functions of the present invention is polypropylene. Although polypropylene has been discussed as being a material for use in the present invention, it is also intended that other materials having similar properties may be adequately substituted therefor. Furthermore, the constructional arrangement as aforedescribed facilitates the molding of the suitable polypropylene or other material in simple cavities without side cores. This has the particular advantage of providing for a relatively simple and yet inexpensively produced safety device 12. By virtue of the fact that since the first locking means 30 is secured to the valve pedestal 22, and the hinge means 34 serves to bias the second locking means 32 between the pedestal 22 and actuator head 26, a very compact safety locking arrangement is furnished.

Having thus described the preferred embodiment of the present invention, its mode of operation, in conjunction with a typical aerosol valve assembly means 18, associated with a conventional aerosol container 10 will be subsequently described.

To attach the safety lock device 12 to the aerosol spray container 10, the first locking ring member 36 is placed over the valve pedestal 22. As aforementioned, by virtue of the serrated edges 40, the first locking means 30 is enabled to be snugly fit about pedestal 22. As noted previously, such serrated edges 40 provide for wide versatility in attachment. The second locking member 44 of the second means 32 is initially aligned with and passed over the actuator head 26. As a result of the bias, afforded by the biased hinge means 34, the obstruction portion 48 is urged toward and into engagement with valve stem 24, as shown by the solid lines in FIG. 1. It will be appreciated, of course, that whenever in this particular position, the complete downward stroke of the actuator head 26, necessary to perform a dispensing operation, will be hindered. Moreover, the parallel grooves 58 serve to prevent the second locking member 44 from slipping generally laterally from beneath the actuator head 26 upon depression of the latter, whenever the second locking member 44 is in the locked position. Accordingly, if a child should depress the actuator head 26 without first accomplishing the proper unlocking sequence to be described, the spray will not be discharged through the nozzle 28.

As more clearly shown in FIG. 5, to successfully actuate the dispensing valve assembly means 18, so as to place the aerosol container 10 in use, a person merely has to grasp the container in one hand and may with the middle finger urge the second locking member 44 to the unlocked position, as indicated in FIG. 5, or as more clearly shown by the phantom lines indicated in FIG. 1 wherein the remaining portion 57 of the elliptical opening 46 is aligned with the actuator head 26. In this particular position, manual depression of the actuator head 26 toward the valve pedestal 22 is permitted to thereby enable dispensing of the pressurized content of the container 10. Consequently, as is believed readily apparent, this particular unlocking sequence requires the opening portion 57 in the second locking member 44 to remain aligned as above indicated, while the actuator head 26 is depressed. Accordingly, two separate and simultaneously performed actions are required to dispense the pressurized contents. At the conclusion of the spraying operation, release of the actuator head 26 results in it being forced upwardly to the inoperative position. Likewise, release of the locking device 12 permits the biased hinge means 34, by reason of its inherent resiliency, to automatically urge the second locking means 32 back to its locked position, see the solid lines in FIG. 1. At this position, the obstruction portion 48 and arm portions 54 are situated beneath the actuator head 26. Thusly, care need not be exercised in insuring that the dispensing valve assembly means 18 be relocked. By this aforementioned constructional arrangement, a reliable locking device is provided. Moreover, it will be extremely difficult for a child of very young years to inadvertently dispense the pressurized contents. Because to dispense such contents, simultaneous operations of maintaining alignment between the elliptical opening 46 and actuator head 26, and the manual depression of head must be performed. Such a sequence is believed beyond the competency of many young children. Moreover, since the first locking mean is only attached to the pedestal 22 and the hinge means 34 urges the second locking means 32 to the aforenoted locked position the overall length of the locking device 12 when so assembled only extends partially over the lip of the central cup member 20 and, as such, the overall dimension is rather small. Accordingly, the bendable and resilient locking device 12 may easily fit under existing decorative and/or protective caps.

Figure 6:
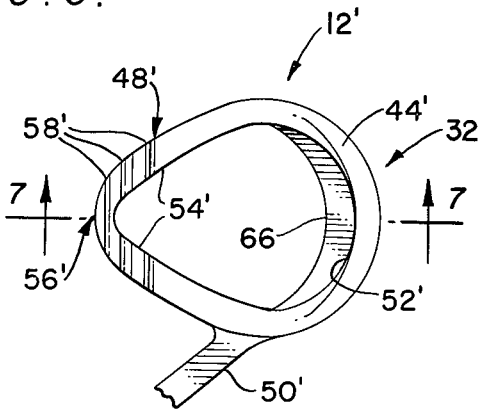
FIG. 6 is an enlarged fragmented plan view of a first alternate embodiment of the child-proof safety locking device of the present invention.
Figure 7:
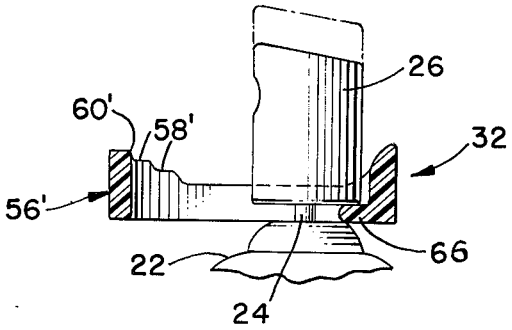
FIG. 7 is a side elevational view of the first alternate embodiment of the child-proof safety locking device of the present invention cooperating with the push-button actuator head of the aerosol container.

Referring to the second embodiment of the invention, illustrated in FIGS. 6 and 7, parts corresponding to those of the previous construction have been designated by similar reference characters with, however, the addition of a prime marking. As particularly depicted in FIG. 6, the second locking means 32' has been somewhat modified to include a relatively thin molded retaining lip or section 66. Such retaining lip 66 extends into the elliptical opening 46' and serves to prevent any tendency of the second locking means 32' to be urged upwardly by the hinge means (not shown) around the actuator head 26 or downwardly over the pedestal 22. The thinness of the retaining lip 66 is designed to extend into the opening 46' by a distance which is sufficient, whenever the second locking member 44' is in the unlocked position, to be situated either above the valve pedestal 22 or below the actuator head 26. Hence, if the hinge means 34' should have a tendency to either raise or lower the second locking member 44', the retaining lip 66 acts to strike and prevent it from doing so. Thusly, the second locking member 44' will be properly positioned throughout the useful life of the safety device 12'. For if the second locking member 44' had otherwise fallen down over the valve pedestal 22 or risen around or above the actuator head 26, it would not, upon release of the head 26, be urged back to the locked position between the head and pedestal. By reason of the fact that the retaining lip 66 is of a relatively thin dimension, it will not obstruct the necessary movement required of the actuator head 26 for dispensing purposes as the latter is moved downwardly towards the valve pedestal 22. Therefore, the dispensing valve assembly means 18 is permitted to discharge the pressurized contents through the nozzle 28.

Figure 8:
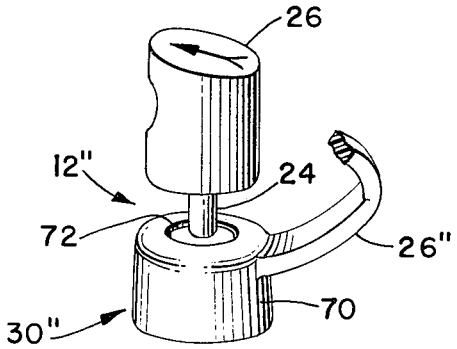
FIG. 8 is a somewhat enlarged perspective view of a second alternate embodiment of the child-proof safety locking device mounted on and locked to a valve pedestal of the aerosol spray container; and, FIG. 9 is an exploded view illustrating the manner by which the second alternate embodiment is attached to the valve pedestal.
Figure 9:
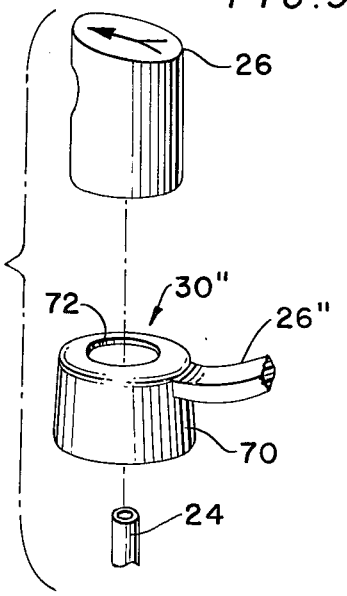

Now referring to FIGS. 8 and 9, there is disclosed a third embodiment of the present invention with parts thereof similar to the preferred embodiment being designated by similar reference characters with, however, the addition of two prime markings. As therein depicted, the first locking means 30'' differs from the others in that it is defined by a generally cup-shaped member 70 instead of a ring-shaped member having a plurality of serrated edges. The cup-shaped locking member 70 is adapted to fit over the valve pedestal 22 and has an opening 72 which permits passage of the valve stem 24 (see FIG. 9). The advantage of the cup-shaped locking member 70 is that it generally provides for a better fit and provides for an improved aesthetic appearance. Of course, the cup-shaped member 70 will be suitably molded and dimensioned to fit over specific sized valve pedestals.

By virtue of the above disclosure, it will be appreciated that the child-proof safety locking devices of the present invention will be adaptable to most vertical action aerosol valves. The snugness of fit provided by the first locking members with the valve pedestal, and the retaining lip on the second locking member, serve to maintain such locking device in place throughout the useful life of the aerosol container. In addition, the safety locking device is relatively simple in construction and small in dimension, thusly it may be situated beneath conventional decoration and/or protective overcaps. Owing to its unitary construction simple configuration it lends itself to be easily and economically manufactured in simple mold cavities.

While the aforedescribed embodiments have been directed to a child-proof safety locking device for aerosol type dispensing containers, it should be, of course, pointed out that the principles of the present invention permit its use in other applications wherein it is desired to have a simple, economical, reliable locking device which prevents inadvertant actuation of a device should a vertically movable actuator member for operating such a device be inadvertantly moved.

While the invention has been described in connection with the foregoing embodiments it is not intended to limit the invention to the particular forms set forth above, but on the contrary, it is intended to cover such alternative modifications and equivalents as may be included within the spirit and scope of the invention as defined by the appended claims.

What is claimed is:

1. A safety locking device adapted for use in selectively locking an aerosol type valve assembly on aerosol container having a movable valve stem connected to a push-button actuator head which stem is slidable within a valve pedestal formed on the valve assembly to thereby prevent depression of the actuator head such that the contents of the container cannot be dispensed comprising, in integral combination, at least a pair of first and second locking means formed adjacent opposite ends of said locking device, said first locking means being adapted to be removably secured to the valve pedestal, and said second locking means being movable between locked and unlocked positions wherein whenever in the locked position it is interposed between the actuator head and the valve pedestal to prevent depression of the actuator head toward the valve pedestal, and wherein, in the unlocked position permits depression of the actuator head toward the valve pedestal, and biased hinge means having said first and second locking means respectively connected therewith for biasing said second locking means with respect to said first locking means such that whenever said first locking means is secured to the valve pedestal said second locking means is biased to the locking position, and for automatically returning said second locking means from said unlocked position to said locked position whenever application of force sufficient to overcome the bias of said biased hinge means for urging said second locking means toward the unlocked position is released, said second locking means includes a second locking member which defines therethrough a generally elliptical opening of sufficient dimension to permit the passage therethrough of the push-button actuator head whenever said second locking means is in the unlocked position, said second locking member also defining an obstruction portion which whenever said second locking means is in the locked position said obstruction portion is so situated to obstruct movement of the push-button actuator head towards the valve pedestal, said obstruction portion being defined by an integral V-shaped portion which gradually tapers upwardly towards the apex thereof for facilitating ranges of valve stem and push-button actuator head heights above said second locking means, said obstruction portion also being formed with a plurality of discrete generally parallel grooves for preventing side slip of said second locking member in response to downward movement of the push-button actuator head towards the valve pedestal whenever said second locking means is in said locked position.

2. A safety locking device particularly adapted for use in selectively inhibiting actuation of an aerosol valve assembly for an aerosol container having a movable valve stem connected to a push-button actuator head which stem is slidable within a valve pedestal formed on the valve assembly such that the pressurized contents of the container may not be dispensed upon depression of the valve comprising, in integral combination, at least a pair of first and second locking means formed adjacent opposite ends of said locking device, said first locking means being adapted to be secured to the valve pedestal, and said second locking means being selectively movable between locked and unlocked positions wherein, whenever in the locked position it is interposed between the push-button actuator head and the valve pedestal to thereby prevent depression of the actuator head towards the valve pedestal so as to prevent dispensing of the pressurized contents of the aerosol container, and whenever the second locking means is in the unlocked position, it permits depression of the actuator head towards the valve pedestal to thereby permit dispensing of the pressurized contents, and biased hinge means having said first and second locking means respectively interconnected therewith for biasing said second locking means with respect to said first locking means such that whenever said first locking means is secured to the valve pedestal said second locking means is based to the locking position where it is interposed between the actuator head and pedestal and for automatically returning said second locking means from said unlocked position to said locked position whenever application of force sufficient to overcome the bias of said biased hinge means for urging said second locking means towards the unlocked position is released.

3. A valve safety device as set forth in claim 2 in which said safety device is fabricated from polypropylene.

4. A safety locking device as set forth in claim 2 in which said first and second locking means respectively include first and second locking arm connecting portions for connecting said first and second locking means to said biased hinge means.

5. A safety locking device as set forth in claim 2 in which said hinge means tends to bias said second locking means generally upwardly so as to be interposed between the valve pedestal and the push-button actuator head whenever said second locking means is in the second position.

6. A safety locking device as set forth in claim 2 in which said first locking means includes a generally cup-shaped member with an opening formed therethrough, said cup-shaped member being received on the top of the valve pedestal.

7. A safety locking device as set forth in claim 2 in which said first locking means includes a first locking ring defining an opening therethrough.

8. A safety locking device as set forth in claim 7 in which said first locking ring has an internal periphery thereof formed by serrated edges.

9. A safety locking device as set forth in claim 2 in which said second locking means includes a second locking member which defines therethrough a generally elliptical opening of sufficient dimension to permit the passage therethrough of the push-button actuator head whenever said second locking means is in the unlocked position, said second locking member also defining an obstruction portion which whenever said second locking means is in the locked position is so situated to obstruct movement of the push-button actuator head towards the valve pedestal.

10. A safety locking device as set forth in claim 9 in which said obstruction portion is defined by an integral V-shaped portion which gradually tapers upwardly towards an apex portion thereof for facilitating various ranges of valve stem and push-button actuator head heights above said second locking means.

11. A safety device as set forth in claim 10 in which said obstruction portion is formed with a plurality of discrete parallel grooves for preventing side slip of said second locking means whenever said push-button actuator head is moved towards the valve pedestal.

12. A safety locking device is formed with at least one groove for preventing slide slippage of said second locking member in response to downward movement of the push-button actuator head towards the valve pedestal whenever said second locking means is in said locked position.

13. A safety locking device as set forth in claim 9 in which opposite ends of said elliptical opening are tapered generally upwardly and outwardly along a major axis for said elliptical opening for facilitating the accommodation of various valve stems and push-button actuator head heights above said second locking means.

14. A safety locking device as set forth in claim 9 in which said second locking means includes a lip portion which partially extends into said elliptical opening and is relatively thin with respect to said second locking member.

* * * * *

UNITED STATES PATENT OFFICE
CERTIFICATE OF CORRECTION

PATENT NO. : 3,940,023
DATED : February 24, 1976
INVENTOR(S) : Herbert R. Umstead It is certified that error appears in the above-identified patent and that said Letters Patent are hereby corrected as shown below:

In the title, "CHILD-PROOF SAFETY LOCKING DEVICE FOR AEROSOL VALVES" should be -- SAFETY LOCKING DEVICE FOR AEROSOL VALVES --;

Col. 1, line 18, "approximately" should be --appropriately--;

Col. 3, line 24, "chile" should be --child--;

Col. 4, line 17, "the" should be --and--;

Col. 4, line 38, "centally" should be --centrally--;

Col. 5, line 8, insert --to-- after "dimensioned";

Col. 9, line 34, after "construction" insert --and--;

Col. 9, line 55, before "aerosol" (second occurrence), insert --an--;

Col. 10, line 63, "based" should be --biased--;

Col. 12, line 16, after "device" insert --as set forth in claim 9 in which said obstruction portion--.

Signed and Sealed this
Thirteenth Day of July 1976

[SEAL]

*Attest:*

RUTH C. MASON
*Attesting Officer*

C. MARSHALL DANN
*Commissioner of Patents and Trademarks*